US007770694B2

(12) United States Patent
Baars et al.

(10) Patent No.: US 7,770,694 B2
(45) Date of Patent: Aug. 10, 2010

(54) RESONATOR ARRANGEMENT IN AN ACOUSTIC MUFFLER FOR A REFRIGERATION COMPRESSOR

(75) Inventors: Edmar Baars, Joinville-Sc (BR); Edson Correa Miguel, Joinville-Sc (BR)

(73) Assignee: Whirlpool S.A., Sao Paulo-Sp (BR)

( * ) Notice: Subject to any disclaimer, the term of this patent is extended or adjusted under 35 U.S.C. 154(b) by 0 days.

(21) Appl. No.: 12/298,578

(22) PCT Filed: May 2, 2007

(86) PCT No.: PCT/BR2007/000104

§ 371 (c)(1),
(2), (4) Date: Nov. 12, 2008

(87) PCT Pub. No.: WO2007/124552

PCT Pub. Date: Nov. 8, 2007

(65) Prior Publication Data

US 2009/0178881 A1 Jul. 16, 2009

(30) Foreign Application Priority Data

May 3, 2006 (BR) ..... 0601716

(51) Int. Cl.
*F01N 1/02* (2006.01)

(52) U.S. Cl. ..... 181/403; 181/250; 181/251; 181/266; 417/312

(58) Field of Classification Search ..... 181/229, 181/249, 250, 251, 255, 257, 262, 265, 266, 181/268, 269, 273, 276, 279, 280, 282, 403; 417/312

See application file for complete search history.

(56) References Cited

U.S. PATENT DOCUMENTS 4,209,076 A * 6/1980 Franco et al. ..... 181/272
5,760,348 A * 6/1998 Heuser ..... 181/272
6,199,658 B1 * 3/2001 Huff ..... 181/265

(Continued)

FOREIGN PATENT DOCUMENTS

DE 19603979 8/1997

(Continued)

*Primary Examiner*—Jeffrey Donels
*Assistant Examiner*—Jeremy Luks
(74) *Attorney, Agent, or Firm*—Gifford, Krass, Sprinkle, Anderson & Citkowski, P.C.

(57) ABSTRACT

Resonator arrangement in an acoustic muffler for a refrigeration compressor having a shell (1), inside which is mounted an acoustic muffler comprising a hollow body (10) defining at least one dampening chamber (13), which carries a gas inlet duct (20) and a gas outlet duct (30), each presenting a respective length and having a respective wall thickness, at least one of the gas inlet and gas outlet ducts (20, 30) carrying, extending along at least part of its length, a respective plurality of tube type resonant ducts (40), each resonant duct (40) presenting a first end (41), open to the interior of the respective gas duct (20, 30) and a second end (42), opposed to and spaced from the first end (41), each said resonant duct (40) being dimensioned to present a determined length and a determined diameter, which are calculated to define a certain reactive impedance and a certain dissipative impedance for the acoustic muffler, in a determined frequency band.

24 Claims, 10 Drawing Sheets

U.S. PATENT DOCUMENTS

| | | | | |
|---|---|---|---|---|
| 6,283,246 | B1 * | 9/2001 | Nishikawa | 181/255 |
| 6,341,663 | B1 * | 1/2002 | Alex et al. | 181/249 |
| 6,558,137 | B2 * | 5/2003 | Tomell et al. | 417/312 |
| 6,576,028 | B2 * | 6/2003 | Santos | 55/320 |
| 6,763,909 | B2 * | 7/2004 | Svendsen | 181/227 |
| 2002/0129863 | A1 | 9/2002 | Schaake et al. | |
| 2005/0016792 | A1 * | 1/2005 | Graefenstein | 181/253 |
| 2005/0067220 | A1 * | 3/2005 | Keller et al. | 181/250 |

FOREIGN PATENT DOCUMENTS

| | | |
|---|---|---|
| DE | 19751940 | 3/1999 |
| DE | 19902951 | 7/2000 |
| JP | 1193637 | 8/1989 |
| JP | 2003166689 | 6/2003 |
| WO | WO-02101239 | 12/2002 |

* cited by examiner

RESONATOR ARRANGEMENT IN AN ACOUSTIC MUFFLER FOR A REFRIGERATION COMPRESSOR

CROSS-REFERENCE OF RELATED APPLICATIONS

This application is a US National Phase Application under 35 U.S.C. §371 of International Patent Application No. PCT/BR2007/000104, filed May 2, 2007, which claims priority to and the benefit of, Brazilian Patent Application No. PI 0601716-9, filed May 3, 2006, each of which are hereby incorporated by reference in their entirety.

FIELD OF THE INVENTION

The present invention refers to a resonator arrangement to be provided in an acoustic filter or muffler that is, for example, mounted in a gas suction and/or discharge line in a refrigeration compressor, particularly of the type used in small refrigeration systems.

BACKGROUND OF THE INVENTION

The acoustic mufflers are widely used to attenuate the noise transmitted in gas lines and they are particularly employed in compressors to attenuate the pressure transients generated by the opening of the suction and discharge valves of said compressor. In the refrigeration system, these pressure transients give rise to noise in different ways: sound radiation of the compressor due to the excitations of the shell resonances, usually from 2.5 kHz to 10 kHz; sound radiation due to the excitations of the cavity, usually from 300 Hz to 1 kHz; and sound radiation of the refrigeration appliance of the refrigeration system to which the compressor is coupled, due to the excitations of the components of this refrigeration system, mainly resulting from the low frequency pulses up to 2 kHz.

The suction acoustic muffler has several functions that are important for the good operation of the compressor, such as: gas direction, attenuation of the noise generated by the pulses resulting from suction, thermal insulation of the refrigerant gas drawn to the inside of the cylinder, and control of the suction valve dynamics. The suction acoustic mufflers have a major influence in the energetic efficiency of the compressor, due to the thermal insulation of the gas, load loss and valve operational coupling.

Besides the suction acoustic mufflers, the compressors of the refrigeration systems may be also provided, in the discharge thereof, with an acoustic dampening system, usually in the form of an acoustic muffler placed in the gas discharge line of the compressor and which conducts the gas compressed in the interior of the cylinder to a refrigeration system to which the compressor is usually associated.

The acoustic mufflers presently used are basically a combination of the resistive and reactive types, consisting of a sequence of volumes (usually one, two or three volumes in series, also known as expansion chambers) interconnected by gas ducts that conduct the refrigerant gas coming from the suction line directly to the suction valve, said gas ducts being generally open in the two ends thereof for the passage of the refrigerant gas. The acoustic mufflers are formed by gas ducts and volumes (FIGS. 2, 3 and 13) usually made of a solid material (plastic or metallic).

The gas displacement produces pulses, generating noises which are propagated in an opposite direction to that of the gas being displaced to the suction valve (FIG. 2). The smaller said pulses the more efficient the suction acoustic muffler at its acoustic outlet, through which the gas is admitted inside the acoustic muffler.

Its influence on the performance of the compressor is highly important and the dimensioning of the internal volumes and the length of the gas ducts of the suction muffler determines, to a great extent, the efficiency of the latter.

The related literature is rich in examples and applications of acoustic mufflers. (Hansen, H. "Engineering Noise Control", 2003, Spon Press; Lyon, R. H., "Machinery Noise and Diagnostics", 1987, Butterworth Publishers; Munjal, M. L. "Acoustics of Ducts and Mufflers", 1987, New York Wiley-Interscience; Hamilton, J. F. "Measurement and Control of Compressor Noise", 1988, Office of Publications, Purdue University, West Lafayette).

While widely used, the known suction acoustic mufflers of the volume-tube type have the disadvantage of presenting noise peaks in the acoustic modes typical of these tubes and volumes.

These acoustic mufflers present great attenuation in low frequencies (400 Hz to 800 Hz). However, in high frequencies, they lose performance due to the acoustic resonances of the elements in the form of tubes and volumes, generating more noise in the compressors. This behavior is much more intense in the acoustic mufflers of one volume. In general, the increases in the acoustic performance are achieved by increasing the volume or by reducing the diameters of the tubes, which is not always possible.

There are found applications of Helmholtz resonators, consisting of one tube and one volume which, although also attenuating the frequencies in which they are syntonized, have larger dimensions and increase the manufacturing complexity of the acoustic mufflers. Due to the larger size, the utilization of an arrangement of several Helmholtz resonators is unfeasible and its application is restricted to the attenuation of few frequencies.

One of the known techniques to attenuate the noise provoked by the passage of gas through acoustic mufflers is the dissipative technique, which uses fibrous material for constructing the acoustic muffler, in order to dissipate energy. Also known is the reactive technique, in which during wave propagation, a difference of impedance in a given frequency is generated.

However, the known acoustic muffler constructions with resonant reactive attenuation have the disadvantage of acting only in one frequency or in a narrow frequency band around the main frequency. Moreover, as a function of the constructive differences between the compressor and the acoustic muffler, the actuation of the latter in the expected frequency is not always the same, and a variation of about 100 Hz can occur above or below the desired frequency value to be attenuated.

There are known constructions of acoustic mufflers of the reactive type, comprising a plurality of resonators disposed along the extension of tube portions of acoustic mufflers (JP11093637A2), particularly in an arrangement of resonators radially projecting from the respective tube portion.

FIG. 4 illustrates a prior art construction for a resonator arrangement in which a gas duct of an acoustic muffler, not illustrated, comprises a plurality of resonant ducts distributed along the longitudinal extension of the respective gas duct, radially projecting therefrom.

While this solution minimizes the noise produced by the passage of gas through the respective acoustic muffler, it cannot be applied to acoustic mufflers of small refrigeration compressors, due to the large dimensions of said resonators and to the large volume occupied by them in the interior of the dampening chambers of said acoustic mufflers.

OBJECTS OF THE INVENTION

It is an object of the present invention to provide a resonator arrangement in an acoustic muffler for a refrigeration compressor which can be applied to small compressors with an efficient attenuation of a wide frequency band in the respective acoustic muffler.

It is a further object to provide a resonator arrangement of the tube type as cited above, which does not require modifying the dimensions of the suction muffler.

It is another object of the present invention to provide an arrangement as cited above, which allows reducing the dimensions of the resonators, allowing the provision of more resonators in each resonator duct.

It is also an object of the present invention to provide an arrangement as cited above, which minimizes the load losses of the compressor, producing a better noise attenuation of the pulses caused by suction or compression of the gas inside the cylinder, both in the low and the high frequencies.

It is a more specific object of the present invention to provide a resonator arrangement as cited above, which results in higher efficiency and higher power for the electric motors of the compressors to which said mufflers are associated.

SUMMARY OF THE INVENTION

These and other objects of the present invention are attained by the provision of a resonator arrangement in an acoustic muffler for a refrigeration compressor mounted in the interior of a hermetic shell, said acoustic muffler comprising a hollow body defining at least one dampening chamber that carries a gas inlet duct having an inlet opening outside the dampening chamber and an outlet opening inside the dampening chamber, and a gas outlet duct having an inlet opening inside the dampening chamber and an outlet opening outside said dampening chamber, each said gas duct presenting a respective length and having a respective wall thickness, at least one of the gas inlet and gas outlet ducts carrying, extending along at least part of its length, a respective plurality of resonant ducts, each resonant duct presenting a first end, open to the interior of the respective gas duct and a second end, opposite to and spaced from the first end, each said resonant duct being dimensioned to present a determined length and a determined diameter, which are calculated to define a certain reactive impedance and a certain dissipative impedance for the acoustic muffler, in a determined frequency band.

BRIEF DESCRIPTION OF THE DRAWINGS

The invention will be described bellow, based upon the appended drawings given by way of example of one embodiment of the invention, and in which.

DESCRIPTION OF THE ILLUSTRATED EMBODIMENTS

Figure 1:
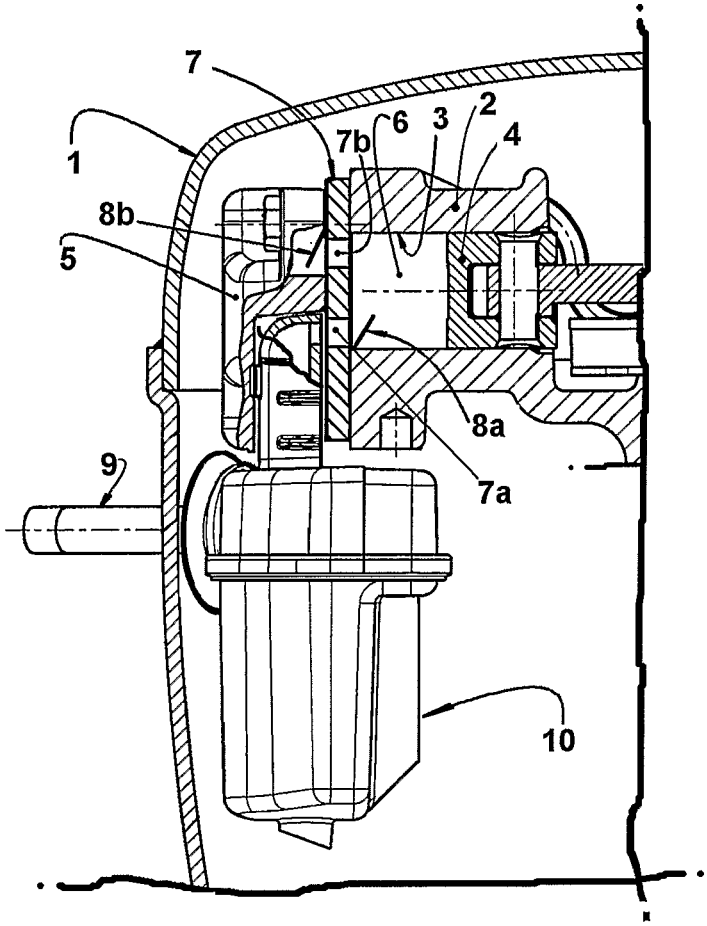
FIG. 1 PRIOR ART
FIG. 1 represents, schematically and partially, a longitudinal sectional view of a compressor carrying an acoustic muffler that is particularly provided in the suction line of said refrigeration compressor.

The present invention will be described in relation to acoustic mufflers mounted in a refrigeration compressor of the type used in small refrigeration appliances and which comprises, within a hermetic shell 1, a motor-compressor assembly having a cylinder block 2 in which is defined a cylinder 3 lodging, at one end, a piston 4 and having an opposite end closed by a cylinder cover 5 which defines, therewithin, a discharge chamber (not illustrated) in selective fluid communication with a compression chamber 6 defined inside the cylinder 3 between a top portion of the piston 4 and a valve plate 7 provided between the opposite end of the cylinder 3 and the cylinder cover 5, through a suction orifice 7*a* and a discharge orifice 7*b* provided in said valve plate 7 and which are selective and respectively closed by a suction valve 8*a* and a discharge valve 8*b*.

As illustrated in the appended drawings, the gas drawn by the compressor and coming from a suction line 9 of the refrigeration system to which the compressor is coupled, reaches the interior of the shell 1 through a suction acoustic muffler usually provided in the interior of said shell 1 and maintained in fluid communication with the suction orifice 7*a* of the valve plate 7.

Figure 2:
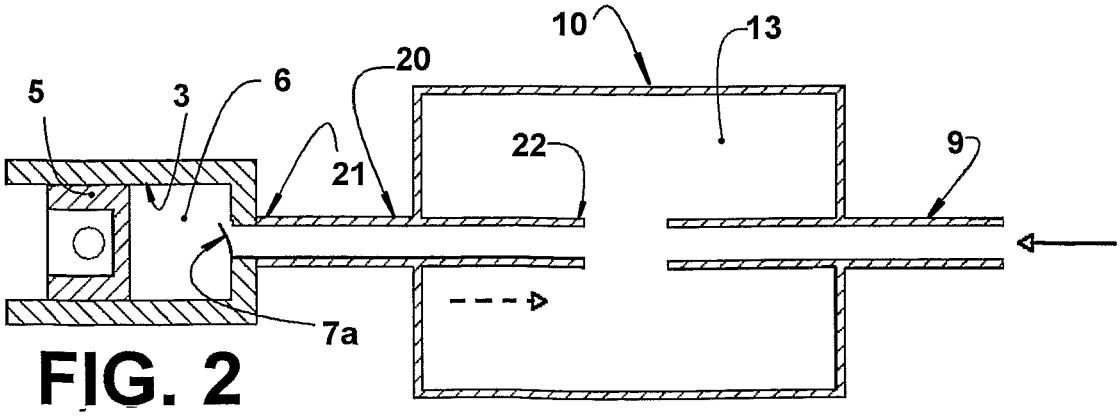
FIG. 2 PRIOR ART
FIG. 2 represents, schematically, a suction line of a compressor, indicating, in a full line, the gas flow direction and, in dashed lines, the noise propagation direction.

The acoustic muffler, to which is applied the solution of the present invention, will be described herein as a suction acoustic muffler, such as that illustrated in FIG. 3, comprising a hollow body 10, usually obtained in a material of low thermal conductivity, for example plastic, presenting a base portion 11 that is hermetically closed by a cover 12 and retained thereto by appropriate means, such as glue, clamps, saliences, interference or by a peripheral band, not illustrated. According to the illustrations, the hollow body 10 has a determined wall thickness for each of the parts of base portion 11 and cover 12 generally matching with one another, said hollow body 10 defining, internally, at least one dampening chamber 13 (FIG. 2 and FIG. 11) that carries a gas inlet duct 20 having an inlet opening 21 outside the dampening chamber 13 and an outlet opening 22 inside the dampening chamber 13, and a gas outlet duct 30 having an inlet opening 31 inside the dampening chamber 13 and an outlet opening 32 outside said dampening chamber 13.

Figure 4:
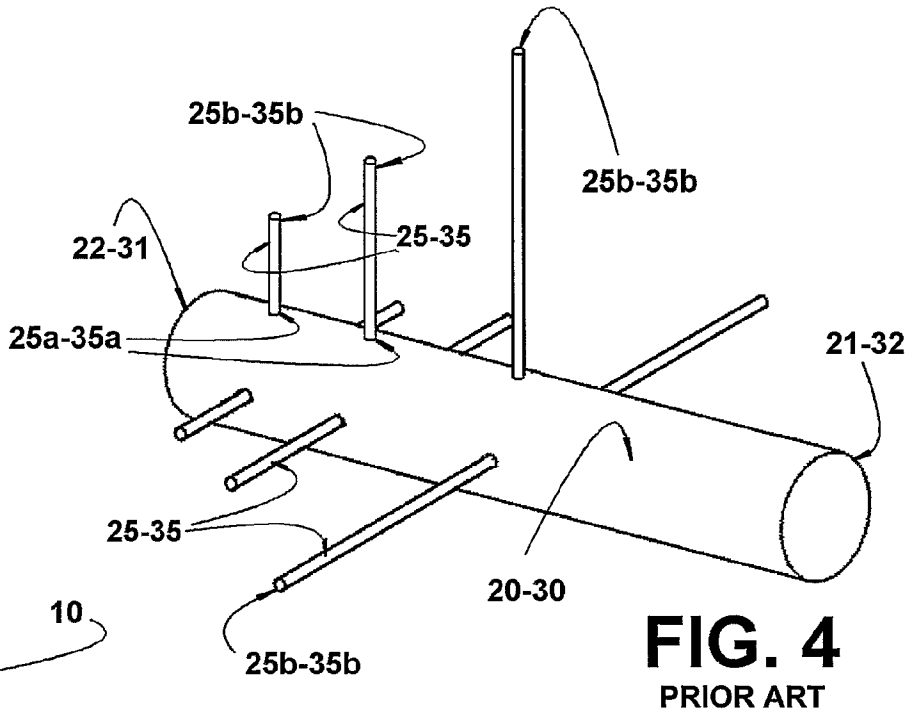
FIG. 4 PRIOR ART
FIG. 4 represents, schematically, a perspective view of a gas conducting tube construction of an acoustic muffler, presenting a conventional resonator arrangement.

In the construction illustrated in FIG. 1, the suction acoustic muffler presents a gas inlet duct 20 having its inlet opening 21 in fluid communication with the gas supply to the compressor and connected to the suction line of the refrigeration system to which the compressor is coupled, and its outlet opening 22 in fluid communication with a suction side of the compressor, for example directly connected to the suction orifice 7*a* of the valve plate 7 of the compressor. Each gas duct 20, 30 has a respective length and a respective wall thickness. FIG. 4 shows a prior art construction of a resonator arrangement in which a gas duct 20, 30 comprises a plurality of resonant ducts 25, 35 distributed along the length of the respective gas duct 20, 30, radially projecting therefrom, each said resonant duct 25, 35 having predetermined length and wall thickness. In this construction, each resonant duct 25, 35 presents a first end 25*a*, 35*a* open to the interior of the respective gas duct 20, 30, and a second end 25*b*, 35*b* opposite to and radially spaced from the first end 25*a*, 35*a*. This construction presents the deficiencies already described hereinabove.

According to the present invention, at least one of the gas inlet duct 20 and gas outlet duct 30 carries, extending along at least part of its length, a respective plurality of resonant ducts 40, for example, of the tube type, each said resonant duct 40 presenting a first end 41 open to the interior of the respective gas duct 20, 30, and a second end 42 opposite to and spaced from the first end 41, each said resonant duct 40 being dimensioned to present a determined length and a determined diameter that are calculated to define a certain reactive impedance and a certain dissipative impedance for the acoustic muffler, in a determined frequency band.

In a way of carrying out the present invention, the resonant ducts 40 present at least one of the parameters defined by the diameter and the length with the same value.

The dimensions of the resonant ducts 40 may be equal or distinct, depending on the intended result of attenuation. Thus, if it is desired to widen the frequency band to be attenuated, said dimensions are not equal, they are distinct, or only slightly different. If the attenuation is to be greater in a determined narrower frequency band, the resonant ducts 40 should have the same dimensions.

In the solution of the present invention, the resonant ducts 40 are positioned in a region of the respective gas duct 20, 30 subject to an acoustic pressure which produces noise to be attenuated. In a way of carrying out the present invention, the resonant ducts 40 are positioned according to the same plane transversal to the respective gas duct 20, 30, said transversal plane sectioning a region of maximum acoustic pressure in said gas duct 20, 30.

Figure 3:
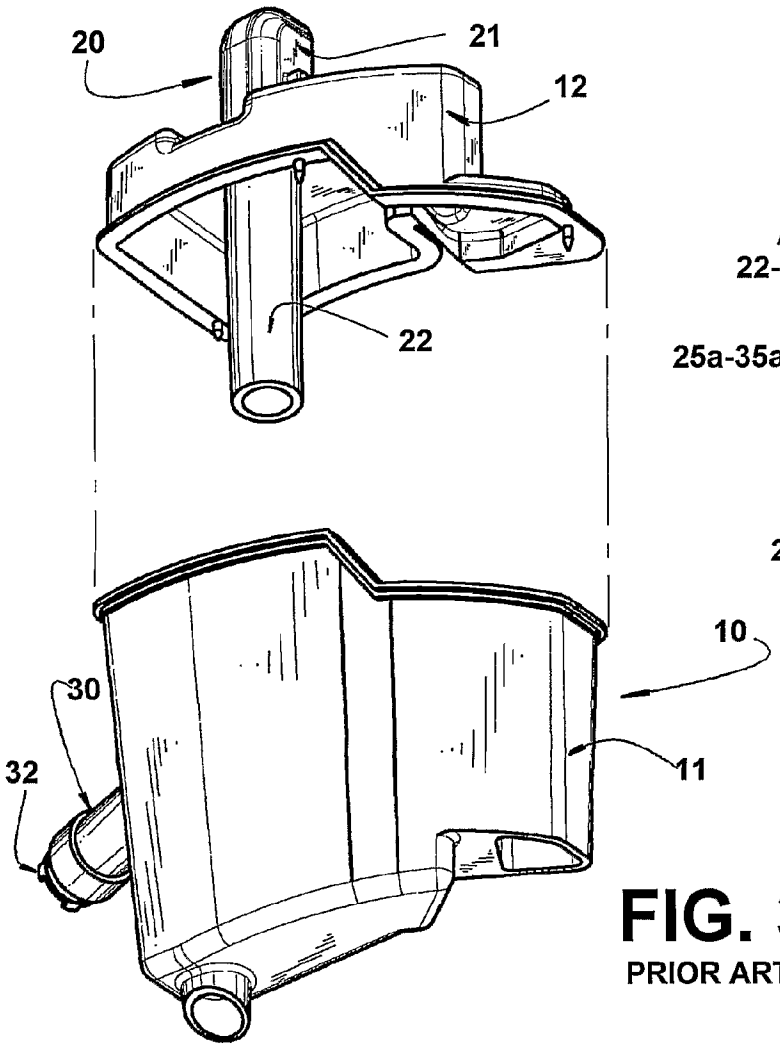
FIG. 3 PRIOR ART
FIG. 3 represents, schematically, an exploded perspective view of an acoustic muffler construction illustrated in FIG. 1.

The present invention utilizes a set of acoustic resonators, for example, of ¼ and ½ the wave length in the elements that form the acoustic mufflers (such as gas ducts, dividing elements or volumes of the hollow body 10 of the acoustic muffler showed in FIG. 3). The resonant ducts 40 are positioned in the walls of the gas ducts and/or in the volumes of the interior of the hollow body 10 of the acoustic muffler, in order to prevent or attenuate the propagation of the sound waves, reflecting or dissipating them by viscous effect, without increasing the load loss upon passage of the gas flow.

According to a way of carrying out of the present invention, the gas duct 20, 30 which carries the plurality of resonant ducts 40, has at least part of said resonant ducts 40 presenting their first ends 41 longitudinally spaced from one another along the extension of the respective gas duct 20, 30, by a distance defined as a function of the frequency band to be attenuated, said spacing being, for example, constant along the extension of the respective gas duct 20, 30. According to the present invention, the second end 42, when internal to the hollow body 10, can be open or closed, as a function of the available space inside the volume of the hollow body 10, and it is open when said space is larger, since the second end 42 requires a larger space to be open. In the constructions in which the second end 42 of a resonant duct 40 is provided in a gas duct portion external to the hollow body 10, said second end 42 must be closed.

In one embodiment of the present invention, the second end 42 of at least part of the resonant ducts 40 is closed.

When applied to the gas ducts 20, 30, the resonant ducts 40 alter the impedance locally, reflecting part of the acoustic energy. When applied in the regions of maximum modal pressure, such resonant ducts 40 operate by removing energy (dissipation) from the main system, reducing the resonance effects. In general, the resonant ducts 40 increase the acoustic attenuation of the acoustic mufflers in the frequencies in which they are syntonized.

In one embodiment of the present invention, the resonant ducts 40 can be injected jointly with the part of the acoustic muffler in which they will be applied, or made in two pieces, as described below and illustrated in FIGS. 5-9.

Figure 11:
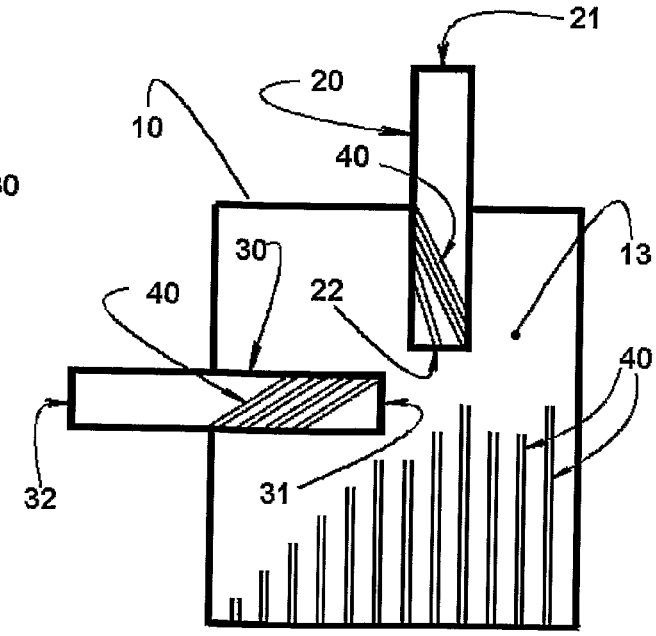
FIG. 11 represents, schematically, a sectional view of an acoustic muffler provided with different resonators constructed according to the present invention.

When applied to the acoustic muffler body, said resonant ducts 40 can be rectilinear or not, all of them being parallel to one another or also parallel to one another by each set of resonant ducts 40, being, for example, in the form of small grooved plates secured by fittings, glue or any other adequate fixation means, or also partially or integrally carried in the wall thickness of the hollow body 10, for example, in the wall thickness of the base portion 11 of said hollow body 10, as illustrated in FIG. 11. In the constructive variant in which the resonant ducts 40 are partially defined in the wall thickness of the base portion 11 of the hollow body 10, such resonant ducts 40 have at least part of their length formed along the inner surface of said base portion 11 of the hollow body 10, the cross-section of each resonant duct 40 being completed by placing a closing element close to the inner surface of the base portion 11 of the hollow body 10, such as a plate. In the case the resonant ducts 40 are totally formed in the wall thickness of the hollow body 10, for example, in the wall thickness of the base portion 11 of the hollow body 10, each resonant duct 40 presents at least its respective first end 41 open to the interior of one of the volumes of the hollow body 10, by providing, for example, holes (not illustrated) defined in said hollow body 10.

The length of the resonant ducts 40 is calculated taking into account the frequencies, or frequency band desired to be attenuated, said resonant ducts 40 being distributed along said frequency band, using the relations below, the difference between the lengths of the resonant ducts 40 depending on the width of the band and the required attenuation.

$$L_i=(C/4f_i)+(8/3\pi)a$$

(resonant duct 40 with one of its ends (first end) open and the other closed)

$$L_i=(C/2f_i)+(16/3\pi)a$$

(resonant duct 40 with its ends open)

Where:

$L_i$—length of the i-esimal resonant duct 40

$f_i$—i-esimal frequency desired to be attenuated

C—sound speed in the gas a—radius of the resonant duct 40

The resonator arrangement of the present invention utilizes a set of resonant ducts 40, each syntonized in a different frequency, but very close to that of another resonant duct 40, in order to result in a wide frequency band with said resonant ducts 40.

According to a way of carrying out of the present invention, the resonant ducts 40 are at least partially carried by an adjacent surface portion of the respective gas duct 20, 30, for example, being secured to said adjacent surface portion or formed therealong, such as a recess 23, 33 produced in an enlarged wall portion 24, 34 of the respective gas duct 20, 30 in which said resonant ducts 40 are provided. In a constructive form, not illustrated, the resonant ducts 40 are affixed by appropriate means in the adjacent gas duct 20, 30.

As can be noted in the constructive forms illustrated in FIGS. 5*b*, 7*b*, 9*a* and 10*a*, the resonant ducts 40 present at least part of their length formed directly in the wall thickness of the respective gas duct 20, 30, so that the first end 41 of each said resonant duct 40 is open to the interior of the respective gas duct 20, 30 by a through hole 26, 36 produced in said gas duct 20, 30.

In these embodiments of the present invention, the resonant ducts 40 present at least part of their length defined by the complementation of two parts: one defined in the body of the gas duct 20, 30 and the other by a tubular sleeve 50, carried by the gas duct 20, 30, internal or external to the latter and defining part of the resonant duct 40, said tubular sleeve 50 presenting a wall thickness and a surface confronting with an adjacent surface of the gas duct 20, 30, the cross section of the resonant ducts 40 being partially defined in each of the adjacent confronting surfaces of tubular sleeve 50 and gas duct 20, 30.

In a constructive variant in which the gas duct 20, 30 carries a tubular sleeve 50, at least part of the length of the resonant ducts 40, defined between the confronting surfaces of the parts of tubular sleeve 50 and gas duct 40, for example, separates said parts. In the constructive variants illustrated in FIGS. 5-8 and 10, at least one gas duct 20, 30 carries a tubular sleeve 50 presenting, in its wall thickness, at least part of the resonant ducts 40, the complementary part of said resonant ducts 40, which defines the remainder of the cross section thereof, being formed by the other of said parts of gas duct 20, 30 and tubular sleeve 50.

In these illustrated constructive variants, the tubular sleeve 50 surrounds at least part of the longitudinal extension of the gas duct 20, 30 where the resonant duct 40 is provided, as described ahead, each resonant duct 40 having part of its cross section defined in one of the adjacent confronting surfaces of the gas duct 20, 30 and tubular sleeve 50.

Figure 5B:
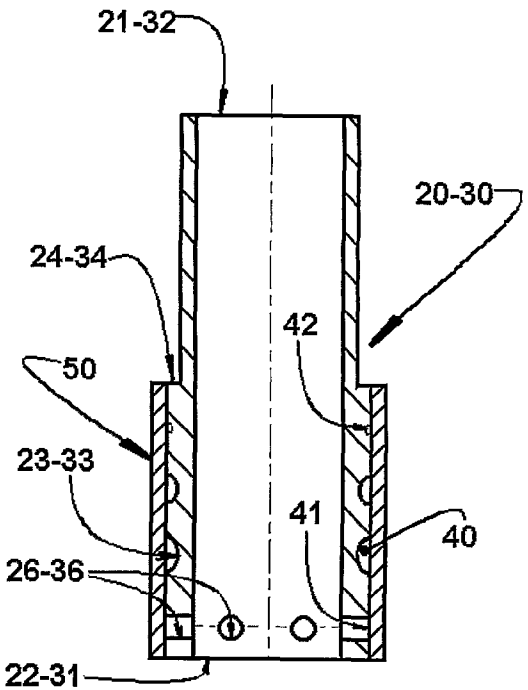
FIG. 5*b* represents, schematically, a longitudinal sectional view of the gas conducting tube illustrated in FIG. 5*a;*
Figure 5A:
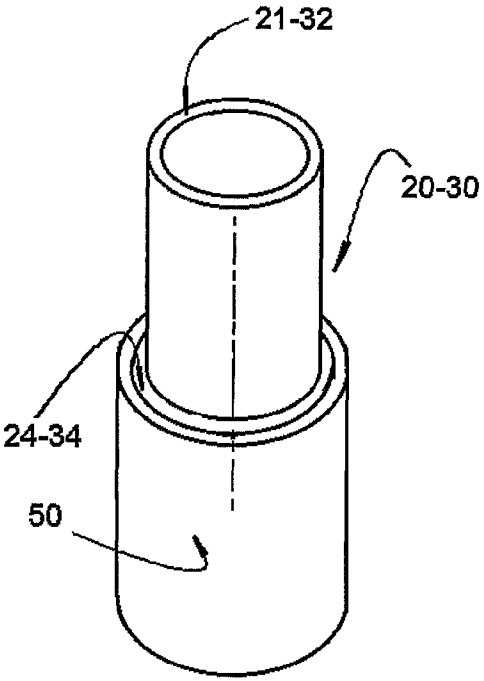
FIGS. 5 and 5*a* represent, schematically and respectively, a perspective view of a construction of a gas conducting tube presenting a resonator arrangement of the present invention, in a condition to be mounted to a tubular sleeve and spaced therefrom.
Figure 5:
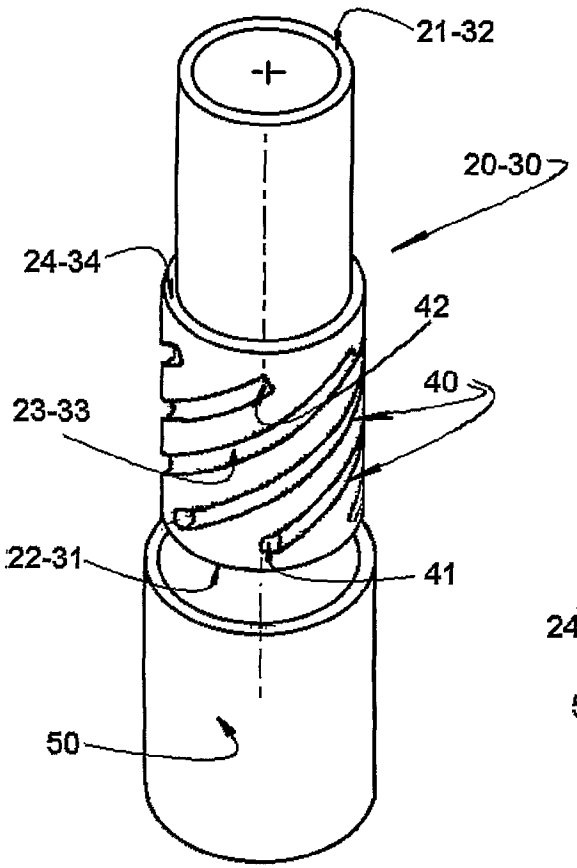
Figure 6B:
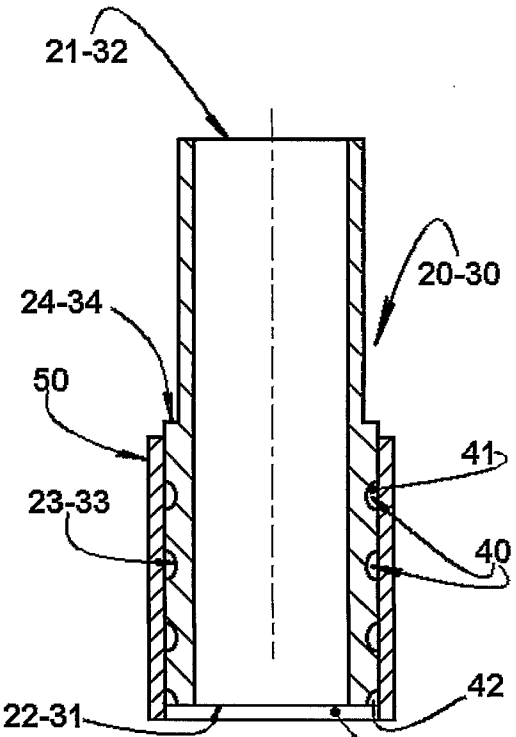
FIGS. 6, 6*a* and 6*b* represent, schematically and as illustrated in FIGS. 5, 5*a* e 5*b*, perspective and longitudinal sectional views of an alternative construction of a gas conducting tube presenting a resonator arrangement of the present invention.
Figure 6A:
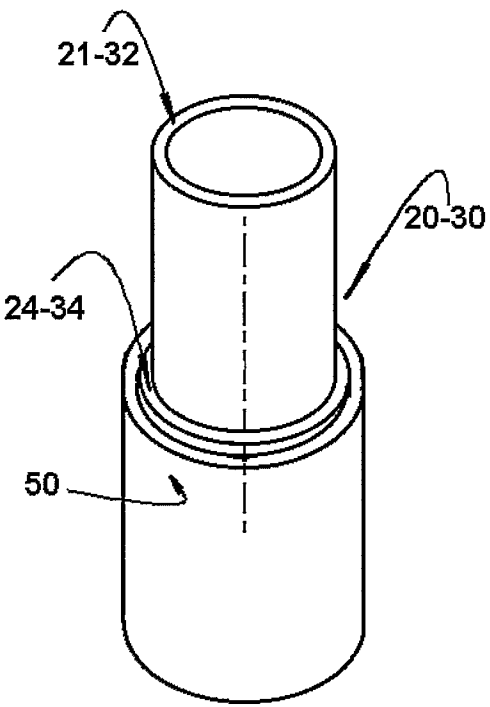
Figure 6:
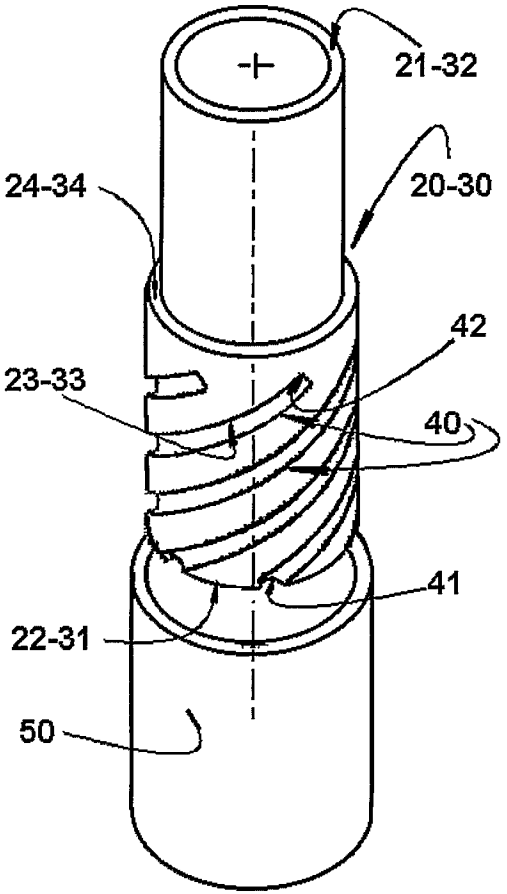
Figure 7B:
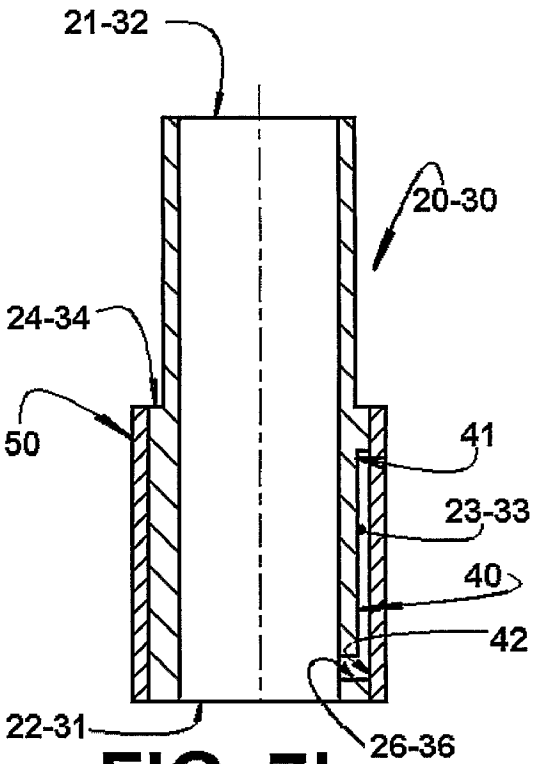
FIGS. 7, 7*a* and 7*b* represent, schematically and as illustrated in FIGS. 5, 5*a* and 5*b*, perspective and longitudinal sectional views of a constructive variant of a gas conducting tube presenting a resonator arrangement of the present invention.
Figure 7A:
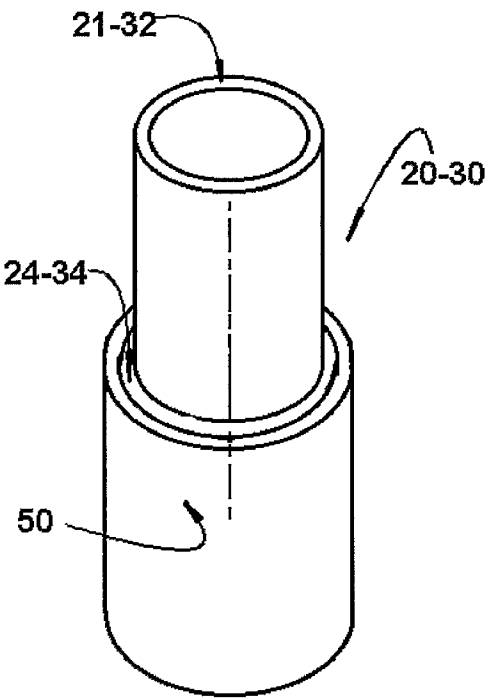
Figure 7:
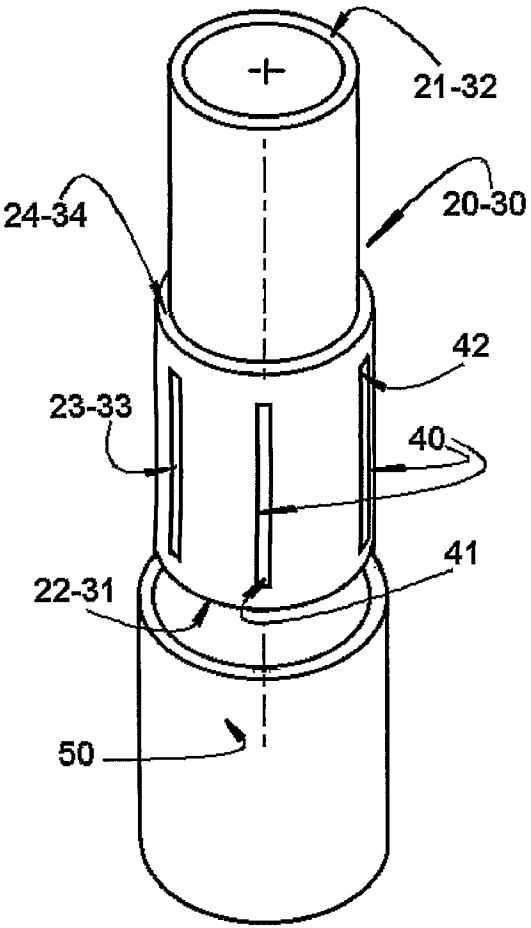

In one of these constructions, each said resonant duct 40 extends along the respective part of gas inlet duct 20, of gas outlet duct 30 and of tubular sleeve 50, provided in helical arrangement, as illustrated in FIGS. 5 and 6, or also provided in a rectilinear arrangement parallel to the axis of the respective part of tubular sleeve 50 and gas duct 20, 30, as illustrated in FIGS. 7-10.

For these constructions, each resonant duct 40 comprises a recess 23, 33, 53, defined in at least one of the extension parts of gas duct 20, 30 and of tubular sleeve 50, carrying at least part of said resonant duct 40.

Figures 8, 8A, 8B:
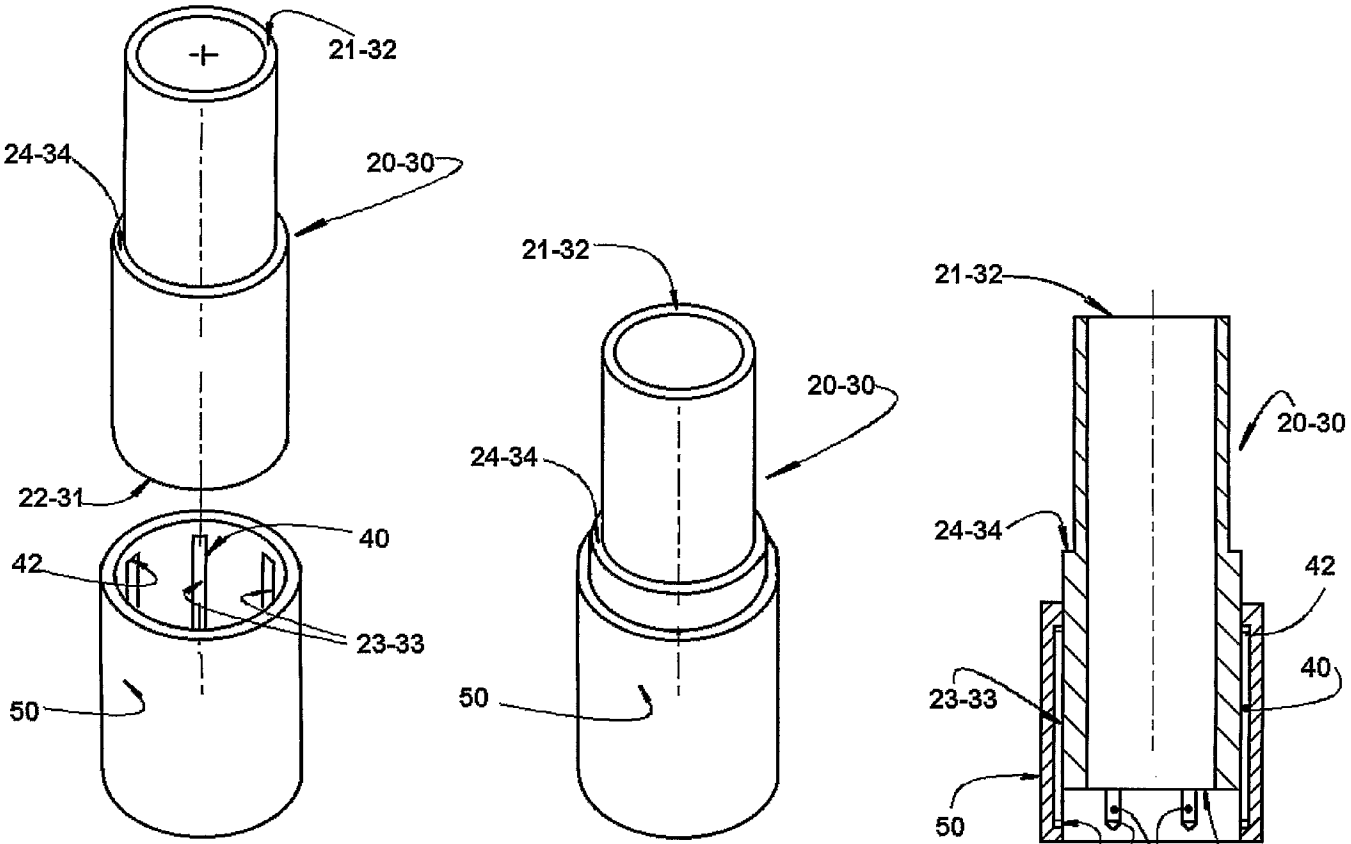
FIGS. 8, 8*a* and 8*b* represent, schematically and as illustrated in FIGS. 5, 5*a* and 5*b*, perspective and longitudinal sectional views of another alternative construction of a gas conducting tube presenting a resonator arrangement of the present invention.

FIGS. 5-7 and 9 illustrate a constructive form of the present invention, in which each resonant duct 40 comprises a recess 23, 33 extending along the outer lateral surface of the respective gas duct 20, 30, whilst in FIG. 8 each resonant duct 40 is defined by a recess 53 provided along the inner surface of the tubular sleeve 50, facing the outer lateral surface of a gas duct 20, 30, upon mounting said tubular sleeve 50 thereto, to define a plurality of resonant ducts 40.

Figure 9B:
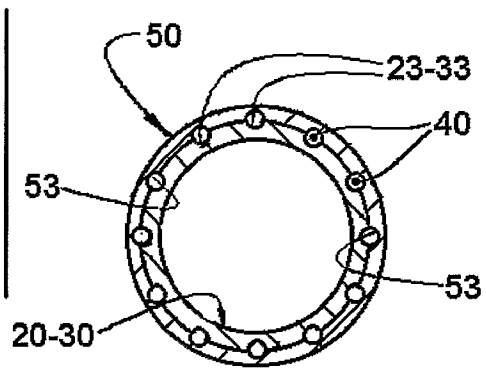
FIGS. 9, 9*a* and 9*b* represent, schematically and respectively, a perspective view, a longitudinal sectional view and a cross-sectional view according to line IX-IX of FIG. 9*a*, of another constructive form of the gas conducting tube presenting a resonator arrangement of the present invention.
Figure 9A:
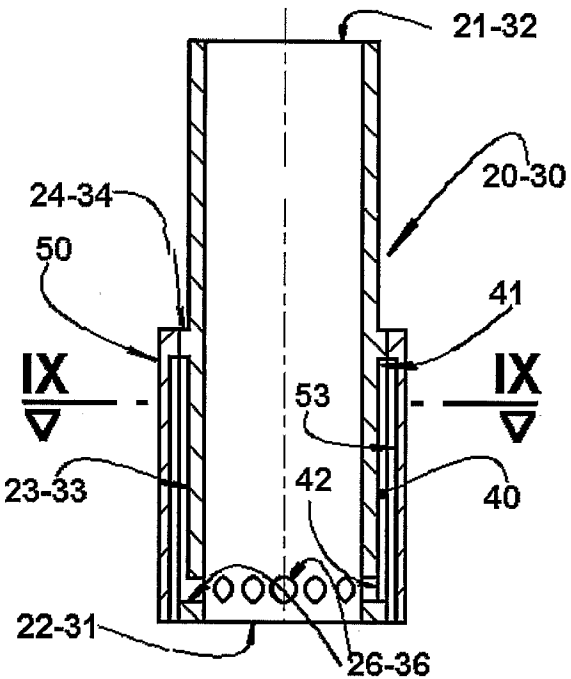
Figure 9:
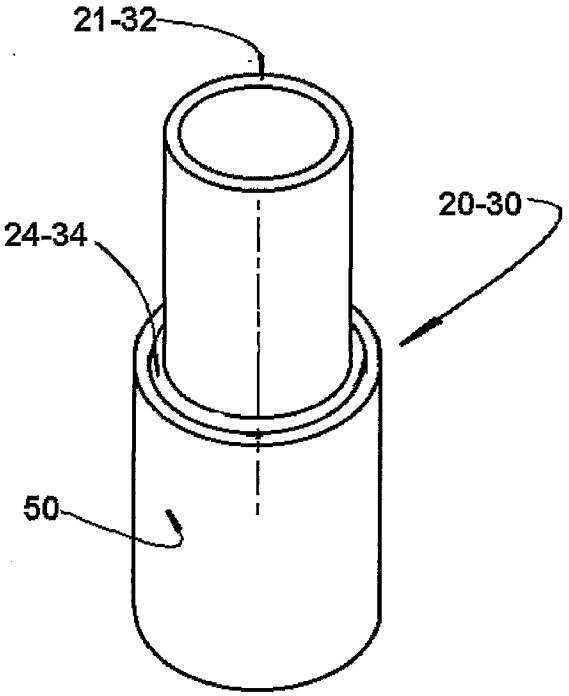
Figure 10:
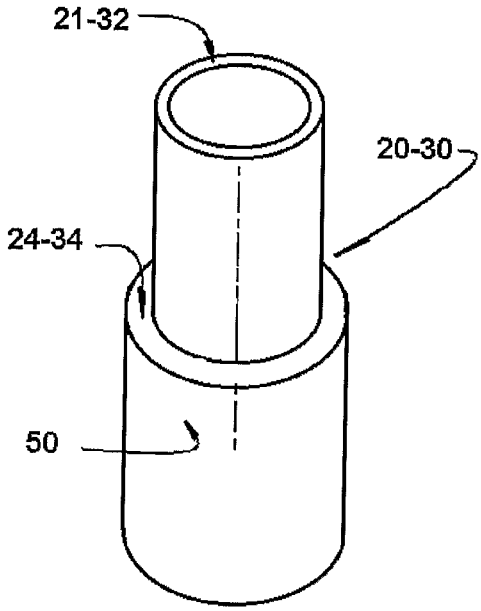
FIGS. 10, 10*a* and 10*b* represent, schematically and as illustrated in FIGS. 9, 9*a* and 9*b*, a perspective view, a longitudinal sectional view and a cross-sectional view, according to line X-X of FIG. 10*a*, of a constructive variant of a gas conducting tube presenting a resonator arrangement of the present invention.
Figure 10A:
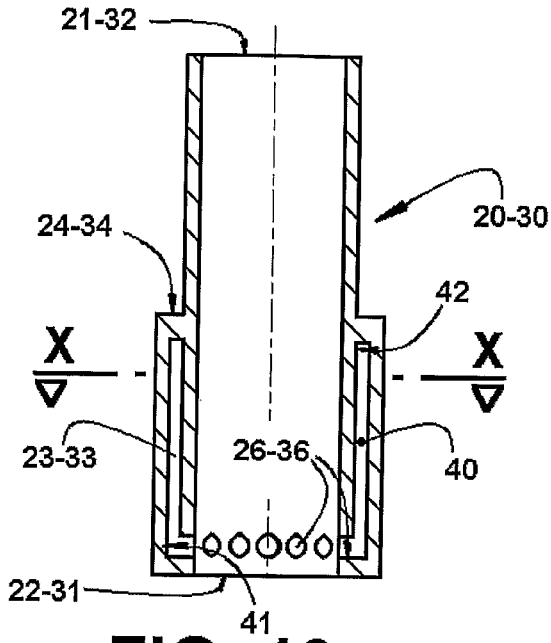
Figure 10B:
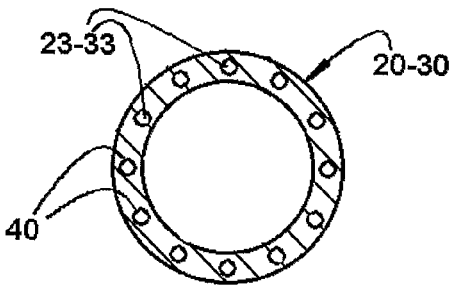

As it can be seen, in the construction of FIGS. 9-9*b*, each part of gas duct 20, 30 and tubular sleeve 50 is provided with a respective recess 23, 33, 53, defining part of the cross section contour of the resonant ducts 40.

According to the illustrations in the enclosed figures, each resonant duct 40 presents its second end 42 closed and its first end 41 opened to the interior of the gas duct 20, 30, in which is defined said recess 23, 43, through a respective radial through hole 26, 36, communicating the interior of said gas duct 20, 30 with the interior of a respective resonant duct 40. Each radial hole 26, 36 is aligned with a respective first end 41, in order to maintain a direct fluid communication therewith. However, although not illustrated, it should be understood that the concept of the present invention also considers the constructions in which the second end 42 of the resonant ducts 40 is open.

In another construction illustrated in FIG. 6, the first end 41 of each resonant duct 40 opens to the end of the respective gas duct 20, 30 facing the interior of the acoustic muffler body.

In another way of carrying out of the present invention, the resonant ducts 40 are totally provided along the wall thickness of the gas duct 20, 30 in which they are provided. In the illustrated solution, the resonant ducts 40 are produced in the wall thickness of an enlarged portion 24, 34 of the respective gas duct in which said resonant ducts 40 are produced.

Although only constructions in which the resonant ducts 40 occupy part of the longitudinal extension of respective gas duct 20, 30 have been illustrated, it should be understood that the concept presented herein is not limited to the illustrated examples. Each resonant duct 40 can occupy the whole longitudinal extension of the respective gas duct 20, 30, this extension being defined as a function of the frequency to be attenuated and from the equations presented above.

One of the advantages of the present invention is to increase the attenuation of the acoustic mufflers in discreet frequencies or in frequency bands in which deficiencies occur, whether due to the constructive form, large diameter of the gas ducts 20, 30 and insufficient volume, or to the presence of undesirable resonances. Since the resonant ducts 40 are tubular shaped and defined extending along the extension of the respective part of gas duct 20, 30 and tubular sleeve 50 (having its ends in the conditions in which they are totally open, or the first end open and the second end closed), said resonant ducts 40 occupy a smaller space, allowing a greater number of them to be used for each respective gas duct 20, 30. This characteristic permits the use of a plurality of resonant ducts 40 of different lengths in each gas duct 20, 30, making possible the attenuation of several frequencies, or of a wider frequency band, which is not possible when a conventional Helmholtz resonator is used.

The helical shape of the resonant ducts 40 allows attenuating low frequencies in short gas ducts 20, 30, which is not obtained with the known prior art attenuating elements.

Other great advantage is the low sensibility to the manufacturing tolerances and to the variations of the operational temperature. With the arrangement of resonant ducts 40 of the present invention, a perfect syntony is not required, once the resonant ducts 40 can have different lengths, which causes an overlapping of the actuating frequencies. The overlapping factor depends on the differences of length and of the diameter between the resonant ducts 40.

The technique described above permits to increase the attenuation of the acoustic mufflers in any frequency band, enabling the geometry of said mufflers to be simplified, increasing their efficiency by increasing the diameters of the resonant ducts, and using acoustic mufflers with a single volume or dampening chamber.

The diameter of each resonant duct 40 and the shape of the respective cross section can be selected according to the manufacturing process and the required attenuation and dimensions. The definition of diameters up to 2 mm or greater defines the attenuation behavior of the resonant duct between totally dissipative (greater diameters) up to totally reactive (diameters up to 2 mm).

Figure 12:
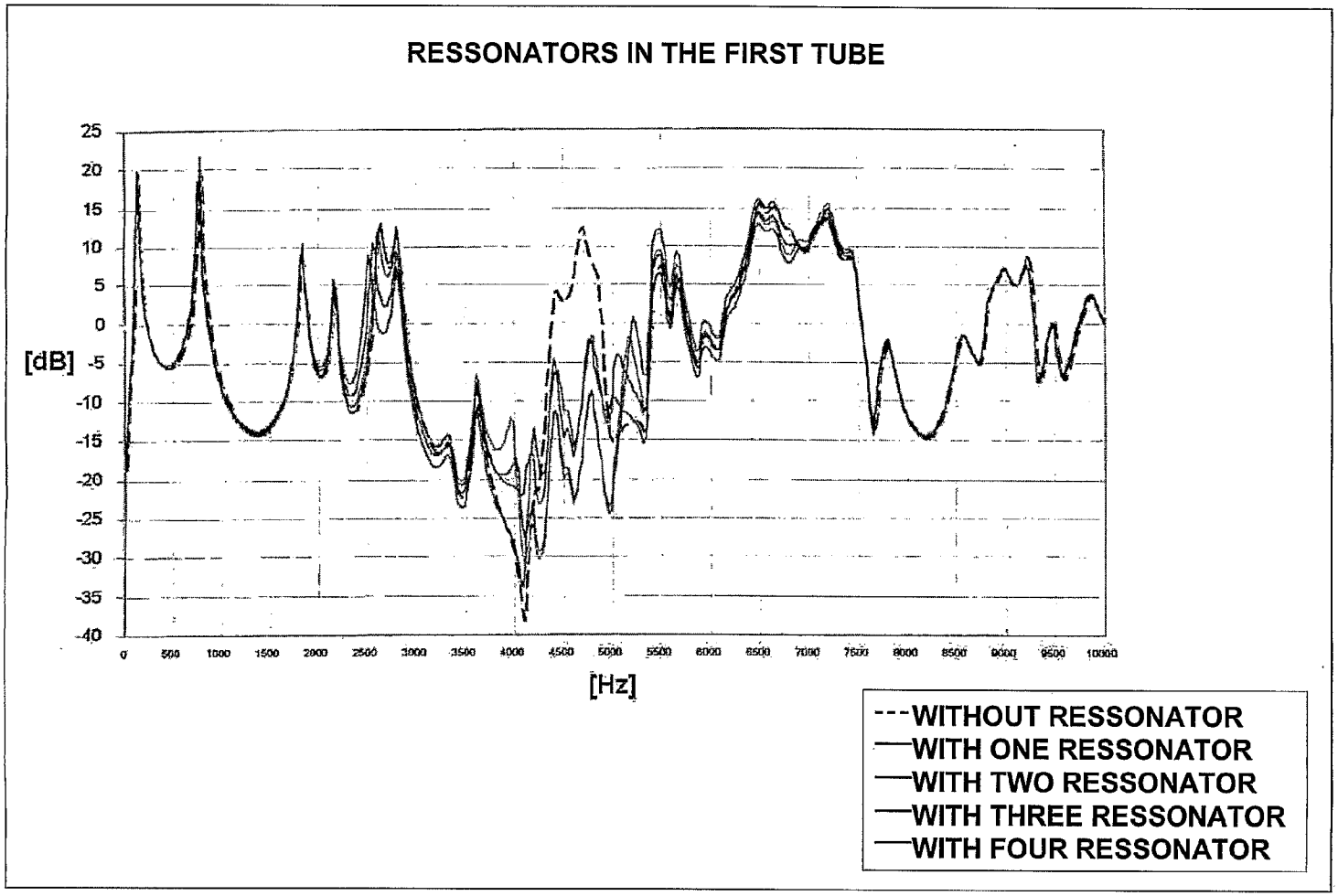
FIG. 12 represents, schematically, a graph illustrating the attenuation curve obtained with a prior art construction of acoustic muffler (dashed lines) and with four different resonator arrangements of the present invention, each said arrangement containing a determined quantity of resonators (full line)
Figure 13:
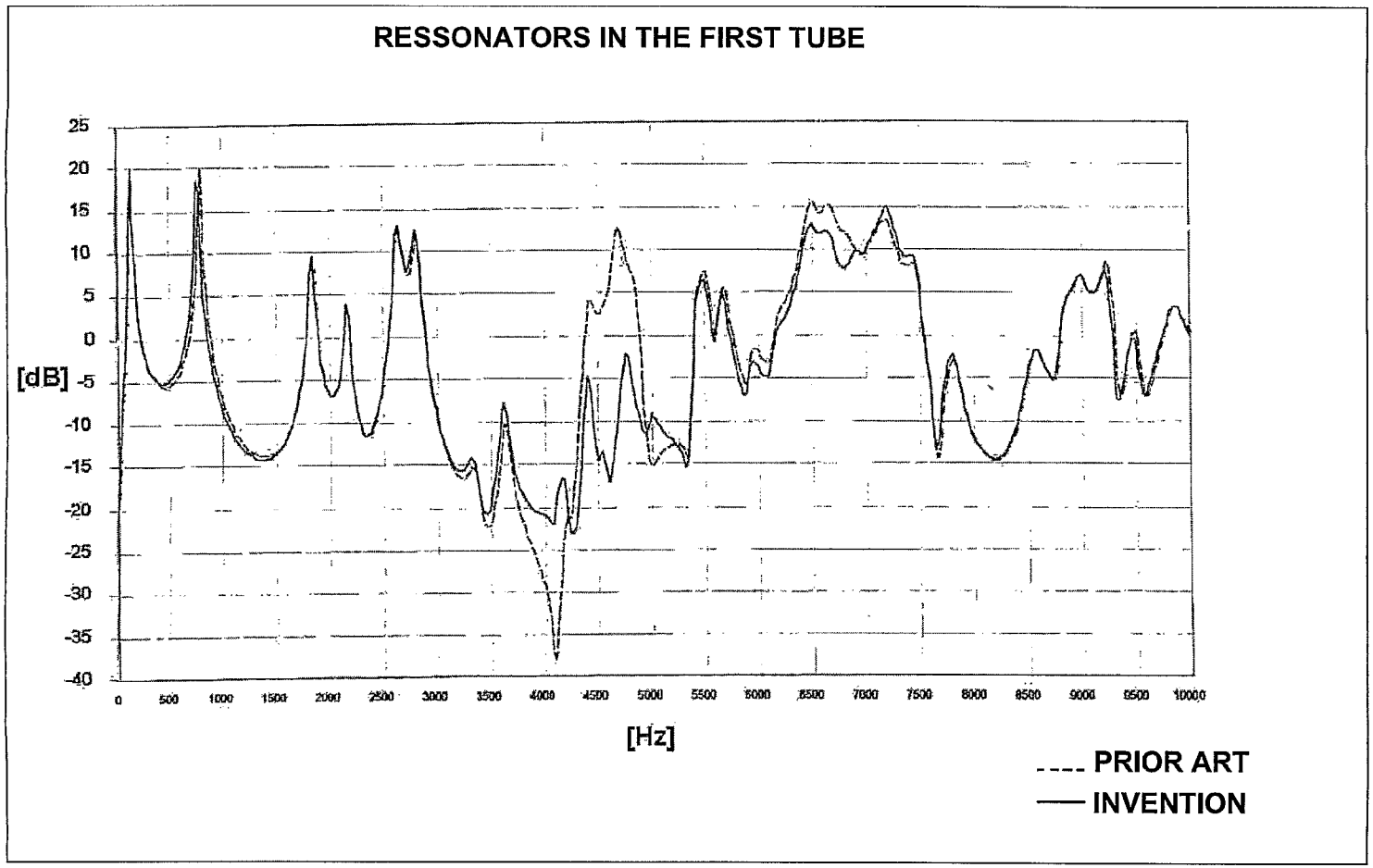
FIG. 13 represents, schematically, the graph of FIG. 12, but illustrating the attenuation curve obtained with the prior art construction of acoustic muffler (dashed lines) and with the resonator arrangement of the present invention containing four resonators (full line).

According to the illustrations of FIGS. 12 and 13, the noise reductions obtained can reach from about 5 to about 20 dB in the response of the acoustic mufflers with the resonator arrangement of the present invention. FIG. 12 shows reduction noise curves obtained with acoustic mufflers presenting arrangements from 1 to 4 resonators, whilst FIG. 13 illustrates only the result presented in the graph of FIG. 13 and obtained with the arrangement of four resonators, in relation of the prior art reduction noise curve without using resonators.

Other advantages are: geometric simplification of the mufflers; low sensibility to the manufacturing tolerances; increase of the energetic efficiency of the compressors; and reduction of the muffler size.

Specific features of the invention are shown in the figures of the enclosed drawings for convenience only, as each feature may be combined with other features according to the invention. Alternative embodiments will be recognized as possible by those skilled in the art and are intended to be included within the scope of the claims. Accordingly, the above description should be construed as illustrating and not limiting the patented scope of the invention. All obvious changes and modifications are within the patented scope defined by the appended claims.

What is claimed is:

1. Resonator arrangement in an acoustic muffler for a refrigeration compressor mounted in the interior of a hermetic shell, said acoustic muffler comprising:

a hollow body defining at least one dampening chamber which carries a gas inlet duct having an inlet opening outside the dampening chamber;

an outlet opening inside the dampening chamber;

a gas outlet duct presenting an inlet opening inside the dampening chamber;

an outlet opening outside said dampening chamber, each said gas duct presenting a respective length and having a respective wall thickness;

wherein at least one of the gas inlet and gas outlet ducts carries, extending along at least part of its length, a respective plurality of resonant ducts, each resonant duct presenting a first end, open to the interior of the respective gas duct and a second end, opposed to and spaced from the first end, each said resonant duct being dimensioned to present a determined length and a determined diameter, which are calculated to define a certain reactive impedance and a certain dissipative impedance for the acoustic muffler, in a determined frequency band.

2. Arrangement, as set forth in claim 1, wherein each resonant duct is at least partially carried by an adjacent surface portion of the respective gas duct.

3. Arrangement, as set forth in claim 2, wherein at least part of the length of each resonant duct is formed in the wall thickness of the respective gas duct.

4. Arrangement, as set forth in claim 2, wherein the gas duct carries, along at least part of its extension, a tubular sleeve presenting a wall thickness, at least part of the resonant ducts being formed in the wall thickness of the tubular sleeve.

5. Arrangement, as set forth in claim 4, wherein the tubular sleeve occupies one of the internal and external positions in relation to the respective gas duct.

6. Arrangement, as set forth in claim 2, wherein the gas duct carries, along at least part of its extension, a tubular sleeve presenting a wall thickness and a surface confronting with an adjacent surface of the gas duct, at least part of the length of the resonant ducts being defined between the confronting surfaces of the tubular sleeve and of the gas duct.

7. Arrangement, as set forth in claim 6, wherein the cross section of the resonant ducts is partially defined in each of the adjacent confronting surfaces of tubular sleeve and of gas duct.

8. Arrangement, as set forth in claim 7, wherein each resonant duct is defined by a recess produced in at least one of the confronting surfaces of tubular sleeve and extension of gas duct.

9. Arrangement, as set forth in claim 6, wherein the tubular sleeve occupies one of the internal and external positions in relation to the respective gas duct.

10. Arrangement, as set forth in claim 2, wherein the resonant ducts are rectilinear and parallel to the axis of the gas duct.

11. Arrangement, as set forth in claim 2, wherein the resonant ducts are provided in a helical arrangement.

12. Arrangement, as set forth in claim 1, wherein at least part of the resonant ducts presents its respective first end positioned in a region of the respective gas duct subjected to an acoustic pressure which produces noise to be attenuated.

13. Arrangement, as set forth in claim 12, wherein at least part of the resonant ducts presents the respective first end open to the interior of the hollow body.

14. Arrangement, as set forth in claim 13, wherein at least part of the resonant ducts presents the respective first end open to the interior of the gas duct, in which they are provided, through a respective radial hole provided in said gas duct and in fluid communication with said first end.

15. Arrangement, as set forth in claim 14, wherein the first end of the resonant ducts is positioned according to the same plane transversal to the respective gas duct, said transversal plane sectioning a region of maximum acoustic pressure in said gas duct.

16. Arrangement, as set forth in claim 1 wherein the second end of each resonant duct is closed.

17. Arrangement, as set forth in claim 1, wherein the second end of each resonant duct is open.

18. Arrangement, as set forth in claim 1, wherein the first ends of at least part of the resonant ducts are longitudinally spaced from one another by a distance defined as a function of the frequency band to be attenuated.

19. Arrangement, as set forth in claim 18, wherein the longitudinal spacing between the first ends of the resonant ducts is constant.

20. Arrangement, as set forth in claim 1, wherein the resonant ducts present at least one of the parameters defined by the diameter and the length with the same value.

21. Arrangement, as set forth in claim 1, wherein the hollow body of the acoustic muffler presents a wall thickness and internally carries at least one resonant duct comprising:

a first end, open to the interior of the respective gas duct;

a second end, opposed to and spaced from the first end;

wherein each said resonant duct being dimensioned to present a determined length and a determined diameter, which are calculated to define a certain reactive impedance and a certain dissipative impedance for the acoustic muffler, in a determined frequency band.

22. Arrangement, as set forth in claim 21, wherein each resonant duct is at least partially carried by an adjacent surface portion of the hollow body.

23. Arrangement, as set forth in claim 20, wherein at least part of the length of each resonant duct is formed in the wall thickness of the hollow body.

24. Arrangement, as set forth in claim 22, wherein the resonant ducts are rectilinear.

* * * * *